US005423436A

United States Patent [19]

Morrow

[11] Patent Number: 5,423,436

[45] Date of Patent: Jun. 13, 1995

[54] PILFER-PROOF PRODUCT DISTRIBUTION SYSTEM

[76] Inventor: Lester A. Morrow, 5940B Takewood La. N., Plymouth, Minn. 55442

[21] Appl. No.: 55,196

[22] Filed: Apr. 28, 1993

[51] Int. Cl.[6] ..... B42F 7/00

[52] U.S. Cl. ..... 211/59.1; 248/220.4

[58] Field of Search ..... 248/220.4, 222.1, 224.3; 211/59.1, 57.1, 54.1; 206/461

[56] References Cited

U.S. PATENT DOCUMENTS

| | | | |
|---|---|---|---|
| 1,411,252 | 4/1922 | Bassett et al. . | |
| 1,590,172 | 6/1926 | Thorberg . | |
| 1,590,591 | 6/1926 | Steffes . | |
| 2,842,264 | 7/1958 | Larson . | |
| 2,906,410 | 9/1959 | McGuire . | |
| 3,374,898 | 3/1968 | Karmin . | |
| 3,481,482 | 12/1969 | Wilkens . | |
| 3,677,415 | 7/1972 | Radek . | |
| 3,785,501 | 1/1974 | Canning . | |
| 3,799,357 | 3/1974 | Govang | 211/59.1 X |
| 3,908,949 | 9/1975 | Larson . | |
| 3,934,727 | 1/1976 | Brefka . | |
| 4,016,977 | 4/1977 | Krautsack . | |
| 4,059,190 | 11/1977 | Conway . | |
| 4,240,552 | 12/1980 | Brown . | |
| 4,258,892 | 3/1981 | Craine . | |
| 4,300,684 | 11/1981 | Smith et al. . | |
| 4,362,249 | 12/1982 | Thalenfeld | 211/59.1 |
| 4,394,909 | 7/1983 | Valiulis et al. . | |
| 4,434,960 | 3/1984 | Berry . | |
| 4,463,510 | 8/1984 | Windish . | |
| 4,474,300 | 10/1984 | Entis . | |
| 4,502,602 | 3/1985 | Swanson | 211/59.1 |
| 4,516,681 | 5/1985 | Jahel . | |
| 4,688,683 | 8/1987 | Thalenfeld et al. . | |
| 4,739,883 | 4/1988 | Mohs et al. | 206/461 X |
| 4,871,135 | 10/1989 | Thalenfeld . | |
| 4,941,632 | 7/1990 | Couls et al. . | |
| 4,974,798 | 12/1990 | Harding et al. . | |
| 5,009,334 | 4/1991 | Bodkins . | |
| 5,014,949 | 5/1991 | Niven . | |
| 5,020,761 | 6/1991 | Good et al. | 211/57.1 X |
| 5,060,897 | 10/1991 | Thalenfeld . | |
| 5,088,606 | 2/1992 | Boas | 211/57.1 |
| 5,114,345 | 9/1992 | Nyman . | |
| 5,263,586 | 11/1993 | Keable | 206/461 X |

FOREIGN PATENT DOCUMENTS 2266513 3/1993 United Kingdom .

OTHER PUBLICATIONS

New Line of Plastic Hooks from Trion, Trion Industries Inc., 1992.

*Primary Examiner*—Ramon O. Ramirez

*Attorney, Agent, or Firm*—Merchant, Gould, Smith, Edell, Welter & Schmidt

[57] ABSTRACT

A product display system is configured to inhibit theft and shoplifting. A product package has an orifice formed therein with a tab extending down through the center top portion of the orifice. The orifice has a lower portion connecting to two side portions. The side portions are configured to extend over a product support member. The product support member has a pair of rods extending substantially parallel with a connecting member at an extended end. The connecting portion of the orifice fits over the connecting member and can pass beyond the connecting member so that the tab extends downward between the rods. Therefore, the package cannot be pulled directly off the end of the support member as the tab engages the cross member. The support member also includes an apparatus for preventing the support member from being pulled from pegboard or other mounting surfaces. The support member includes a second member to prevent the support member from being pivoted to be removed.

17 Claims, 2 Drawing Sheets

PILFER-PROOF PRODUCT DISTRIBUTION SYSTEM

BACKGROUND OF THE INVENTION

1. Field of the Invention

The present invention is directed to an anti-pilfer package support system such as is used for retail displays.

2. Description of the Prior Art

Many types of products are supported on hooks with a plurality of like products aligned on each hook in retail displays. A number of hooks may be supported on pegboard or other surface to provide support for a wide selection of products. Products typically have a flap member extending from the package which has an orifice through which a hook or other support member is inserted to support the package.

A common problem with packages supported on hooks is the ease with which the products may be stolen or may fall off the end the display hook and be damaged. Shoplifting is often a large problem for stores and adds greatly to the cost for security and the cost for lost or stolen merchandise. Products supported on the hooks may be slid from extended end and easily taken. In addition, problems are encountered with "sweeping the hook" wherein all packages supported on the hook are pushed forward and removed. To remove or mount the support, the support is usually pivoted upward so that tabs may be inserted into holes in the pegboard. This allows the hooks to be stolen with the products still supported and presents an additional security problem.

Efforts to provide a support for displaying products while allowing them to be removed without undue effort by the customer, yet difficult to shoplift, have not proven to be satisfactory. Prior devices typically do not prevent shoplifting from easily occurring or cause an undue burden for the purchaser trying to remove the product, so that sales may be affected from additional time and effort required for selecting and removing a single product package. Additional time may also be required stocking the hooks as the pilfer-resistant displays are often difficult to load.

It can be seen then, that an apparatus is needed which allows customer to easily remove one item at a time, yet inhibits theft of multiple items from displays in stores. Such a device should support the packages in a manner which prevents easy removal of all products while not causing an undue burden on the consumers who wish to purchase a product.

SUMMARY OF THE INVENTION

The present invention is directed to a system for supporting products in a manner that allows a single product to be easily removed, yet inhibits easily removing several products at a time. To inhibit shoplifting, multiple packages may not be easily slid from the support. In addition, the present invention prevents easy removal of the support from a pegboard or other mounting surface.

The support includes generally horizontal rods extending from a mounting surface and are connected by a transverse member. The product package has an orifice formed therein or includes a flap having an orifice formed therein. The orifice has a flap extending downward into the orifice to form a lower portion as well as side portions extending upward from the lower portion.

The orifice side portions extend on either side of the flap.

In use, the horizontal rods are extended through the orifice by aligning with the lower portion of the orifice. The transverse member slides through a lower portion of the orifice and allows the product package to be dropped so that the side portions of the orifice on either side of the flap align with the horizontal rods with the flap positioned between the rods. In this position, pulling the package in a horizontal direction, the flap will engage the transverse member and be prevented from sliding off the end of the support. Therefore, to slide the package past the transverse member, the package is lifted so that the lower portion of the orifice is aligned with the transverse member between the rods, and the package may be removed.

The support member includes a mounting member which has tabs or hook members inserting into orifices in pegboard. The support connects on an upper portion of the surface mounting member and prevents that surface mounting member from being pivoted to remove or insert the tabs. Therefore, the support cannot be removed from the pegboard either when pulled directly outward, or when attempted to pivot so as to allow insertion or removal of the tabs through the pegboard's holes.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
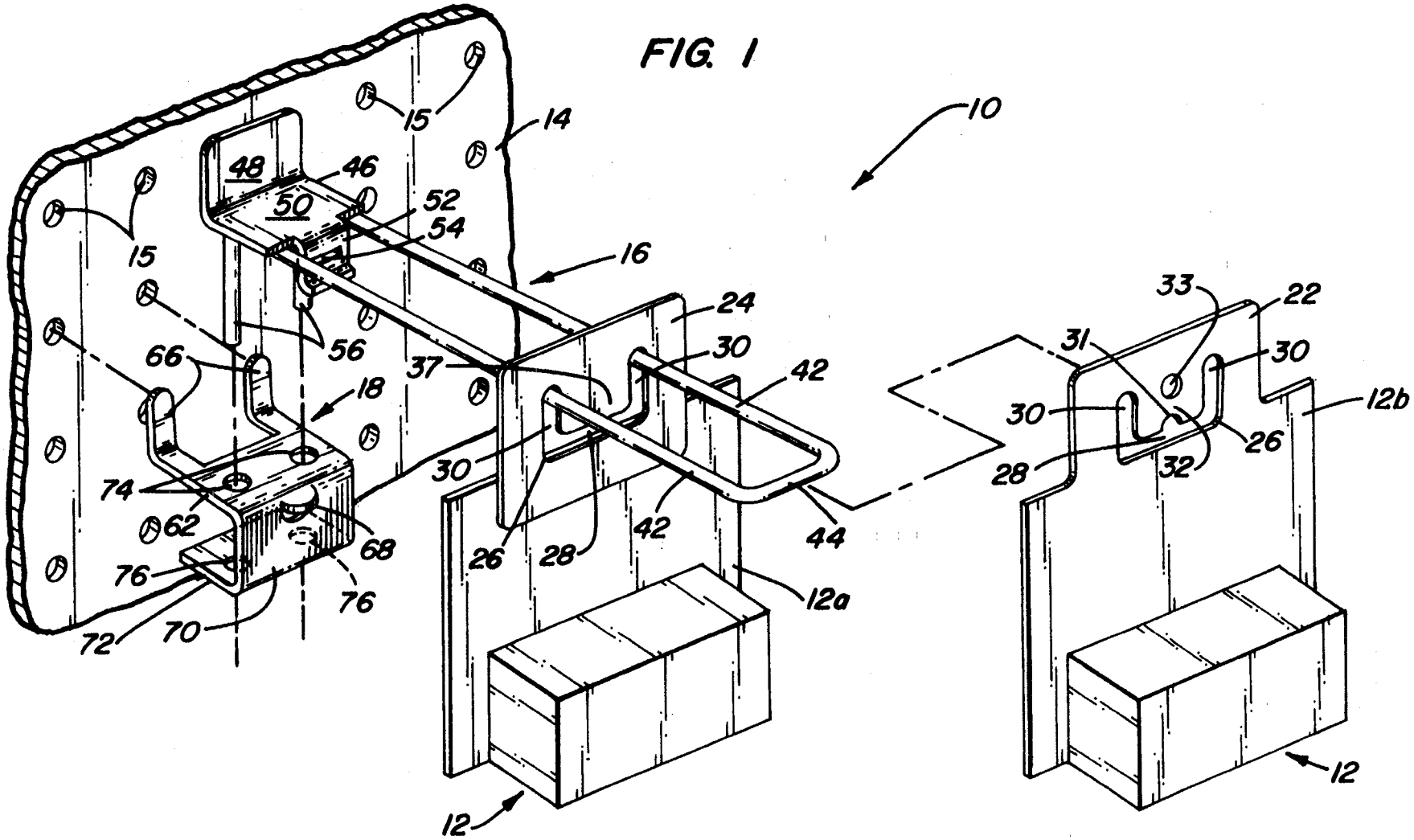
FIG. 1 shows an exploded perspective view of a package support apparatus and packages according to the principles of the present invention.

Referring now to the drawings, and in particular to FIG. 1, there is shown a product support system, generally designated 10. Product packages 12 are typically displayed on a support 16 attached to pegboard 14 having a number of holes 15 formed therein. The support 16 is a generally horizontal member which supports one or more product packages 12. The support 16 connects to a surface mounting member 18 which attaches to the pegboard 14 to prevent pilfering, as explained hereinafter. However, other types of attachment devices may be utilized for attaching to other surfaces.

The product package 12 may include two embodiments, designated **12*a* and 12*b* in FIG. 1. Product package 12*a* includes an add-on flap 24 which is mounted to the product package 12*a* to support the product on the package support 16. Products may also take the embodiment shown at 12***b* wherein an integral flap portion 22 is incorporated into the product packaging. In both embodiments on either flap 22 or 24, an orifice 26 is formed therein. It can also be appreciated that for some types of product packaging, a flap is not required and an orifice 26 may be formed directly through the package. The orifice 26 includes a flap 32 extending through the upper portion of the orifice down through the center portion thereof. The flap 32 forms a lower orifice portion 28 connecting to two orifice upper legs 30, so that in a preferred embodiment, the orifice 26 is substantially U-shaped. As shown in product package 12*b*, the orifice 26 may also include a notch 31 formed therein for attaching to a standard support hook. The package or flap may also include an orifice 33 formed therein for placement on a standard hook in addition to the orifice 26.

Figure 3:
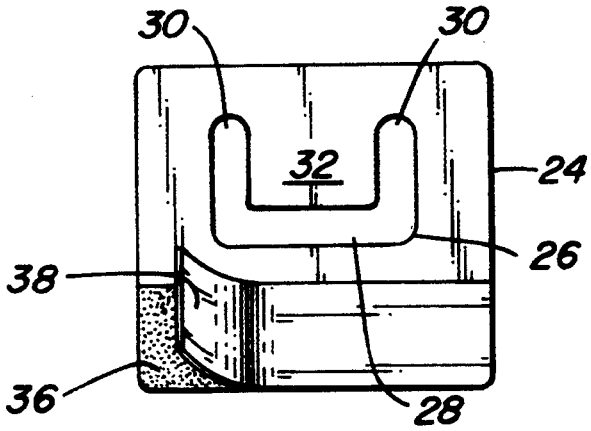

As shown in FIG. 3, in the product package 12*a*, the add-on flap 24 also includes adhesive 36 along the bottom portion thereof. The adhesive 36 is covered with a tear-away strip 38 which is removed when the flap 24 is mounted to the product package 12*a*.

Referring again to FIG. 1, the package support 16 has a pair of substantially vertical rods 42 extending outward from the pegboard. At the extended end thereof, the rods 42 are connected by a transverse member 44 in the same plane as the rods 42. The support member 16 has a mounting member 46 attaching to the surface mounting member 18. The mounting member 46 connects to the rods 42 and includes a vertical planar section 48 and a horizontal planar section 50. A front arm 52 extends downward from the planar section 50 and has a slot 54 formed therein. A pair of vertical columns 56 extend down from the planar section 50 to engage the surface mounting member 18, as explained hereinafter.

Figure 2:
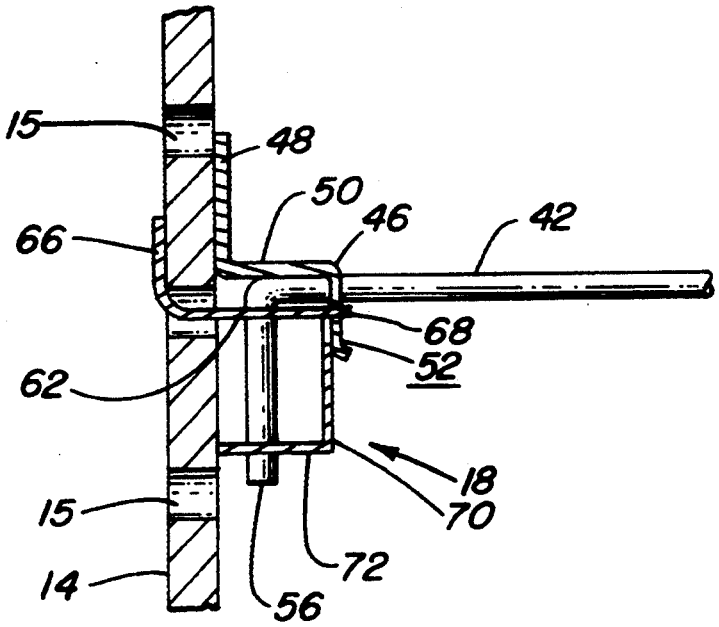
FIG. 2 shows a side elevational view of the package support apparatus shown in FIG. 1; and, FIG. 3 shows a front elevational view of a package attachment member for use with the package support apparatus shown in FIG. 1.

The surface mounting member 18 includes a base 62 having a pair of vertical flaps or hooks 66 at a rear portion thereof. As also shown in FIG. 2, the hooks 66 extend through the holes 15 in the pegboard 14. A front face 70 extends downward at the front of the base portion 62 and connects to a forward spacer portion 72. The face portion 70 includes a flap 68 extending therefrom to engage the slot 54 of the front arm 52, as explained hereinafter. Orifices 74 are formed in the base 62 and orifices 76 are formed in the spacer portion 72 to receive the vertical columns 56. To mount the device 10, the hooks 66 are inserted into holes in the pegboard 14 by tipping the surface mounting member 18 upward. The hooks 66 are slid into the holes 15 and the surface mounting member is pivoted downward until the spacer portion 72 engages the front face of the pegboard 14.

The support member 16 mounts to the surface mounting member 18 by aligning the vertical columns 56 with the orifices 74. The columns 56 are slid into orifices 74 and 72 to properly align the support member 16. The front arm 52 slides over the tab 68 until the tab 68 inserts into the slot 54. The mounting member 46 is supported against the base 62 of the surface mounting member 18.

To remove the device 10, the front arm 52 is pulled to flex outward so that the flap 68 does not extend into the slot 54. The support member 16 may then be lifted upward and removed from the surface mounting member 18. The surface mounting member 18 may then be pivoted upward so that the hooks 66 may be slid out from the holes 15 of the pegboard 14.

In use, as shown in FIG. 1, the packages 12 are slid so that the orifice bottom portion 28 is aligned with the transverse member 44. The packages 12 are then slid further and dropped such that the vertical rods 42 are aligned with the upper legs 30 of the orifice 26. In this manner, the packages 12 are supported with the orifice upper legs 30 engaging the vertical rods 42 of the support member 16.

To remove a product, the packages 12 are slid along the rods toward the transverse member 44. It can be appreciated that at reaching the transverse member 44, by trying to continue to slide the packages 12 from the end of the rods 42, the flap 32 will engage the cross member 44. Therefore, the package 12 must be lifted so that the transverse member 44 and the lower orifice portion 28 are aligned. In this manner, the packages 12 may be slid directly off the end of the support member 16. It can also be appreciate that the packages 12 are retained so that they may not be accidentally pushed off the end of the support member 16, as occurs in other support devices.

It can also be appreciated, as shown in FIGS. 1 and 2, that the support system 10 may not be removed from the pegboard 14 by pulling or pivoting. In prior devices, the support hook may have been removed by tipping it up and sliding the support tabs out from the holes of the pegboard. It can be appreciated that with the present invention, the device 10 may not be tipped up relative to the pegboard 14. When pressure is applied in an upward direction, the vertical section 48 of the mounting member 46 engages the surface of the pegboard 14. If the device 10 is pulled directly outward, the hooks 66 engage the rear of the pegboard 14. If pressure is applied to lower the device, the spacing portion 72 engages the forward surface of the pegboard 14.

It can be further appreciated that with supporting of the products 12 in connection the present invention to the pegboard 14, pilfering will be greatly reduced. Products 12 cannot be slid directly from the end of the support member 16 as the flap 32 engages the cross member 44. This prevents "sweeping the hook" as was easily done with prior support systems. In addition, simply removing the entire hook with the products supported thereon can no longer be done, as the present invention provides safeguards against sliding the surface mounting member 18 and mounting member 46 from the pegboard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for supporting products from a display member, comprising:

a display member, having two substantially horizontal support members joined at an extended end;

package attachment means comprising a product package having a U-shaped orifice formed therein, wherein legs of the U-shaped orifice align with the support members so that upon placement of the support members through the orifice, the support members support the package at the upper portions of the U-shaped orifice.

2. An apparatus according to claim 1, further comprising means for mounting the display member to a mounting surface.

3. An apparatus according to claim 2, wherein the mounting means comprises means for preventing removal of the display member from the mounting surface.

4. An apparatus according to claim 3, wherein the removal preventing means comprises a first member having hook members for engaging holes of pegboard and a second detachable member including means for preventing pivoting the first member.

5. An apparatus for attaching products to a display member comprising:

a support member having two substantially horizontal rod members joined by a cross member at one end;

package attachment means comprising a product package having a U-shaped orifice formed therein, wherein legs of the U-shaped orifice align with the rod members so that upon placement of the rod members through the orifice, the rods support the package at the upper portions of the U-shaped orifice.

6. An apparatus for attaching a product package to a support device comprising an attachment member including means for attaching to the product package, the attachment member including an orifice formed therein, wherein the orifice includes a flap extending downward into the orifice to form an orifice having a pair of spaced apart orifice legs extending upward from a lower cross-connecting portion of the orifice.

7. An apparatus according to claim 6, wherein the support device includes two substantially horizontal rod members configured to align with the orifice legs and support the package at the upper ends of the orifice legs.

8. An apparatus according to claim 7, wherein the rod members are joined by a cross member at an extended end.

9. An apparatus according to claim 6, wherein the attachment member comprises a mounting flap extending from the product package.

10. An apparatus according to claim 6, wherein the orifice includes a notch formed along the upper edge of the connecting portion intermediate the upper legs.

11. An apparatus according to claim 6, further comprising a second orifice formed in the attachment member.

12. An apparatus for displaying products, comprising:

a substantially horizontal display member, having two substantially horizontal rods joined at an extended end;

product attachment means for supporting the product on the display member comprising a planar portion having an orifice formed therein, wherein the orifice has a flap member extending downward into a center portion of the orifice, wherein orifice extends upward on either side of the flap so that the flap extends intermediate the horizontal rods when the display member is inserted through the orifice: and, display member attachment means for attaching the display member to a surface, comprising a surface attachment member having a top portion extending outward from the surface and having a pair of orifices formed therein and a face portion extending down from the top portion, and a tab extending from the face portion, wherein the display member includes vertical members extending through the orifices in the top portion and a plate extending downward to align with the vertical plane of the tab, the plate having an orifice formed therein corresponding to the tab.

13. An apparatus according to claim 12, further comprising a first spacer portion extending from the display member in a first direction and a second spacer portion extending from the surface attachment member in a second direction.

14. An apparatus for attaching a display member to a surface, comprising:

display member attachment means for attaching the display member to a surface, comprising a surface attachment member having a top portion extending outward from the surface having a pair of orifices formed therein and a face extending down from the top portion, and a tab extending from the face, wherein the display member includes vertical members extending through the orifices in the top portion and a plate extending downward to align with the vertical plane of the tab, the plate having an orifice formed therein corresponding to the tab.

15. An apparatus for attaching a product package to a support device, the product package including an orifice formed therein, wherein the orifice includes a flap extending downward into the orifice to form an orifice having a pair of spaced apart orifice legs extending upward from a lower cross-connecting portion of the orifice.

16. An apparatus for attaching a display member to a surface, comprising:

display member attachment means for attaching the display member to a surface, comprising a surface attachment member having a top portion extending outward from the surface and having an orifice formed therein and a face extending down from the top portion, and a tab extending out from the face, wherein the display member includes a vertical member extending through the orifice in the top portion and a plate extending downward to align with the vertical plane of the tab, the plate having an orifice formed therein corresponding to the tab.

17. An apparatus for supporting products from a display member comprising:

a display member, having two substantially horizontal rods joined at an extended end;

product attachment means for supporting the product on the display member comprising a product package portion having an orifice formed therein, wherein the orifice has a flap member extending into a center portion of the orifice, wherein the orifice extends upward on either side of the flap so that the flap extends intermediate the horizontal rods when the display member is inserted through the orifice;

means for mounting the display member to a mounting surface; and means for preventing removal of the display member from the mounting surface comprising a first member having hook members for engaging holes of pegboard and a second detachable member including means for preventing pivoting the first member.

* * * * *

UNITED STATES PATENT AND TRADEMARK OFFICE

CERTIFICATE OF CORRECTION

PATENT NO. : 5,423,436
DATED : June 13, 1995
INVENTOR(S) : Lester A. Morrow

It is certified that error appears in the above-indentified patent and that said Letters Patent is hereby corrected as shown below:

On the title page: Item

[76], delete "Takewood" and insert --Teakwood--.

Item: [73], Assignee: Gage In-Store Marketing LLC, Minneapolis, MN--.

Column 1, line 21, after the word "end" insert --of--.

Column 1, line 25, after the word "from" insert --the--.

Column 1, line 43, after the word "required" insert --when--.

Column 1, line 46, delete "customer" and insert --customers--.

Column 3, line 24, delete "vertical" and insert --horizontal--.

Column 3, line 28, delete "attaching" and insert --attached--.

Column 4, line 2, delete "vertical" and insert --horizontal--.

Column 4, line 5, delete "vertical" and insert --horizontal--.

Column 4, line 16, delete "appreciate" and insert --appreciated--.

UNITED STATES PATENT AND TRADEMARK OFFICE

CERTIFICATE OF CORRECTION

PATENT NO. : 5,423,436

DATED : June 13, 1995

INVENTOR(S) : Lester A. Morrow

It is certified that error appears in the above-indentified patent and that said Letters Patent is hereby corrected as shown below:

Column 4, line 36, aftet the word "connection" insert --with --.

Signed and Sealed this

Nineteenth Day of December, 1995

*Attest:*

*Attesting Officer*

Bruce Lehman

BRUCE LEHMAN

*Commissioner of Patents and Trademarks*